US010376034B2

(12) United States Patent
Chan

(10) Patent No.: US 10,376,034 B2
(45) Date of Patent: Aug. 13, 2019

(54) COSMETIC APPLICATOR HAVING SIDE CONTROL BUTTON

(71) Applicant: Lin-Lang Chan, Taichung (TW)

(72) Inventor: Lin-Lang Chan, Taichung (TW)

(73) Assignee: SHP (HK) TRADING LIMITED, Hong Kong (CN)

( * ) Notice: Subject to any disclaimer, the term of this patent is extended or adjusted under 35 U.S.C. 154(b) by 78 days.

(21) Appl. No.: 15/712,166

(22) Filed: Sep. 22, 2017

(65) Prior Publication Data

US 2019/0090613 A1 Mar. 28, 2019

(51) Int. Cl.

| | |
|---|---|
| ***B43K 21/08*** | (2006.01) |
| ***A45D 40/04*** | (2006.01) |
| ***A45D 40/10*** | (2006.01) |
| ***A45D 40/06*** | (2006.01) |

(52) U.S. Cl.

CPC ..... *A45D 40/04* (2013.01); *A45D 40/06* (2013.01); *A45D 40/065* (2013.01); *A45D 40/10* (2013.01)

(58) Field of Classification Search

CPC ..... A45D 40/04; A45D 40/06; A45D 40/065; A45D 40/10

USPC ..... 401/75, 78

See application file for complete search history.

(56) References Cited

U.S. PATENT DOCUMENTS

2004/0253035 A1* 12/2004 Lee ..... A45D 40/262 401/78

2008/0025785 A1* 1/2008 Ma ..... A45D 40/06 401/87

* cited by examiner

*Primary Examiner* — Jennifer C Chiang

(74) *Attorney, Agent, or Firm* — Leong C. Lei

(57) ABSTRACT

A cosmetic applicator having a side control button includes a pencil-like long tube body, one end of which is engaged with a pencil head-like material holder, in which a slotted seat for the accommodation of a lipstick strip is inserted; the inside of the long tube body is configured with a screw rod, one end of which is connected to the slotted seat; one side of the long tube body is configured with a control button, which is pressed down to drive the screw rod to move the slotted seat toward the top edge of the material holder; the screw rod is turned relatively to the long tube body through the material holder, allowing a ratchet surface of the screw rod to be engaged or released, thereby achieving one-handed operation for material discharge or retreat.

5 Claims, 7 Drawing Sheets

COSMETIC APPLICATOR HAVING SIDE CONTROL BUTTON

TECHNICAL FIELD OF THE INVENTION

The present invention relates to a cosmetic applicator having a side control button, and more particularly to a cosmetic pencil capable of discharging cosmetic material by simple pressing with one-handed operation.

DESCRIPTION OF THE PRIOR ART

Makeup is a politeness behavior and the assistance of self-image enhancement for modern people. In response to the need to facilitate makeup use, many types of makeup tools are commonly developed and uses. Commonly used toiletries such as lipstick, lip balm and lip gloss are used every day especially by many females; these toiletries are mainly provided with a storage body, box or tube. Among these, the tube (pen) type toiletry is inbuilt with a inner tube in connection with a rotation part, which is turned to make the head of cosmetics or the makeup solution of an applicator expose to the outer edge of a cosmetics storing body for cosmetics application or moistening, which, however, usually needs a both hands operation, causing inconvenient cosmetics use.

SUMMARY OF THE INVENTION

To overcome the deficits mentioned above, take cosmetics to use conveniently, make a one-handed operation possible, the present invention is proposed.

The main object of the present invention is to provide a cosmetic applicator having a side control button, allowing cosmetic material to be discharged by one-handed press control operation for the simple cosmetics use by means of bit-by-bit material discharge operation of an inbuilt driving element in engagement with an inbuilt ratchet-like screw rod when a control button on one side of the screw rod is pressed down, thereby achieving convenient cosmetics use.

To achieve the object mentioned above, the present invention proposes a cosmetics applicator having a side control button, including a long tube body for hand griping, a slotted seat adapted to accommodate a lipstick stripe of cosmetic material, a material holder for the insertion of the slotted seat therein, and an outer cover outside the material holder adapted to cover a top end of the long tube body, wherein a top edge of the long tube body is formed into a stepped edge, allowing the engagement of the material holder therewith, thereby constituting a pencil-like makeup tool structure, wherein one side of the long tube body is configured with a side hole for the assembly of a control button therewith, an inner edge of one end thereof is configured with a protruding push edge adapted to push a driving element assembled on a top end of an inside of the long tube body, an outside of the driving element inside the long tube body is configured with an elastic element adapted for the reset assistance of the driving element after slid vertically, an inner bottom of the long tube body assembled with the control button is fixed with a thrust element pressed and positioned by the elastic element, and a barb-like engagement sheets extended downward is respectively configured on two sides of the thrust element; the slotted seat inside the material holder is used for the accommodation of a cosmetic material, a guide insertion hole is configured on a bottom center of the material holder, a screw rod is passed upward through the bottom of the long tube body to be in engagement with the thrust element and driving element, a guide section configured on a face of the screw rod is passed through an corresponding insertion hole of the material holder up to an inner bottom of the material holder to be in combination with the slotted seat, allowing the screw rod to be turned with the material holder, a lower half of the screw rod is set to be a ratchet surface, two sides thereof are respectively formed into a symmetrical flat surface, allowing ratchets to be engaged with the engagement sheets of the driving element and thrust element; the driving element is slid upward when the control button is pressed down, achieving a stable bit-by-bit material discharge when the control button is pressed down continuously; the screw rod, after makeup is done, is driven by the material holder to turn to a state of the flat surfaces facing the engagement sheets, allowing the ratchet surfaces to be separated from and not engaged with the engagement sheets, and the elastic recovery of the elastic element outside the screw will then cause the lipstick strip to be automatically retreated inside the material holder and stored therein safely.

DETAILED DESCRIPTION OF THE PREFERRED EMBODIMENTS

Figure 1:
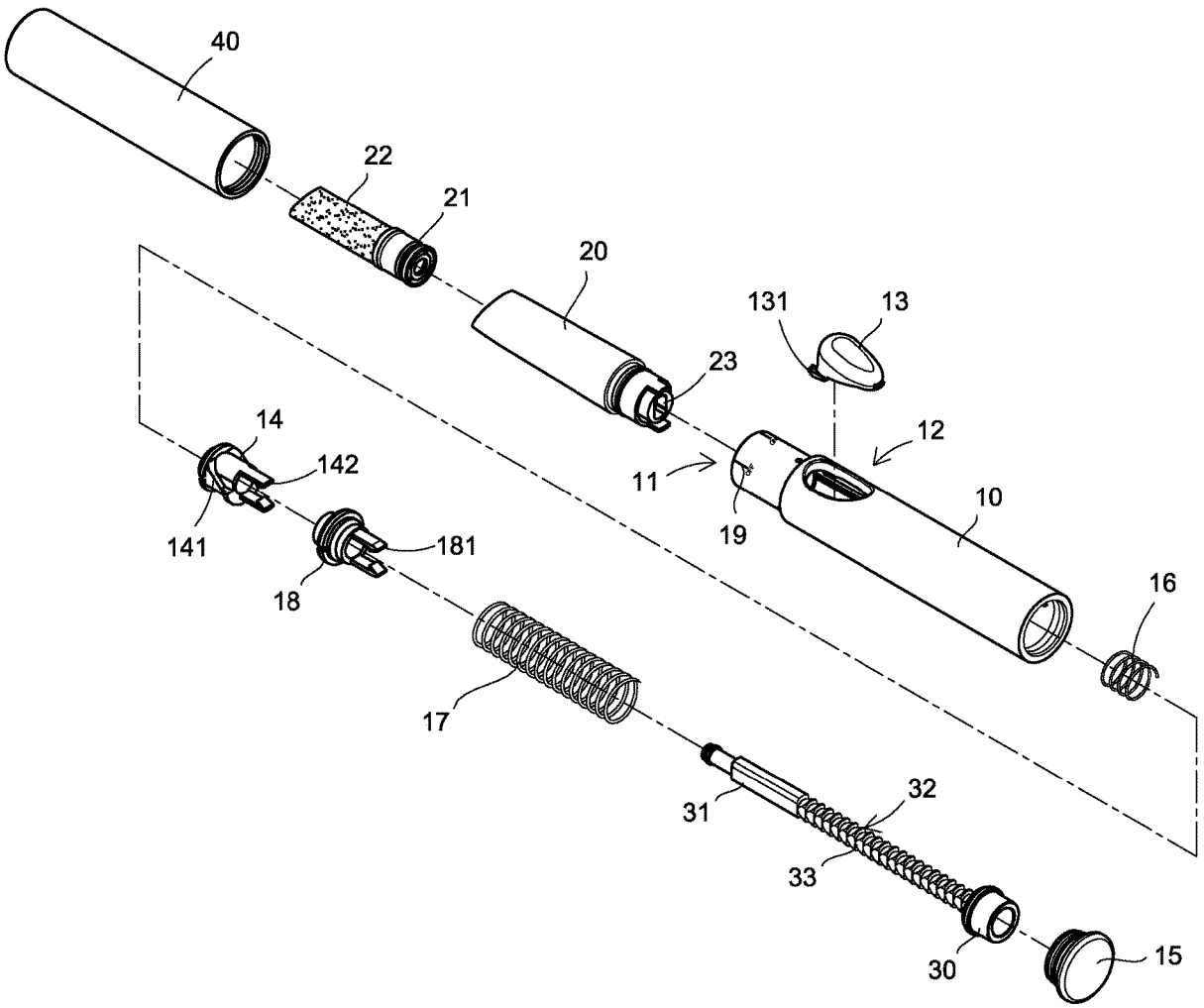
FIG. 1 is an exploded view of a cosmetic applicator of the present invention.
Figure 2:
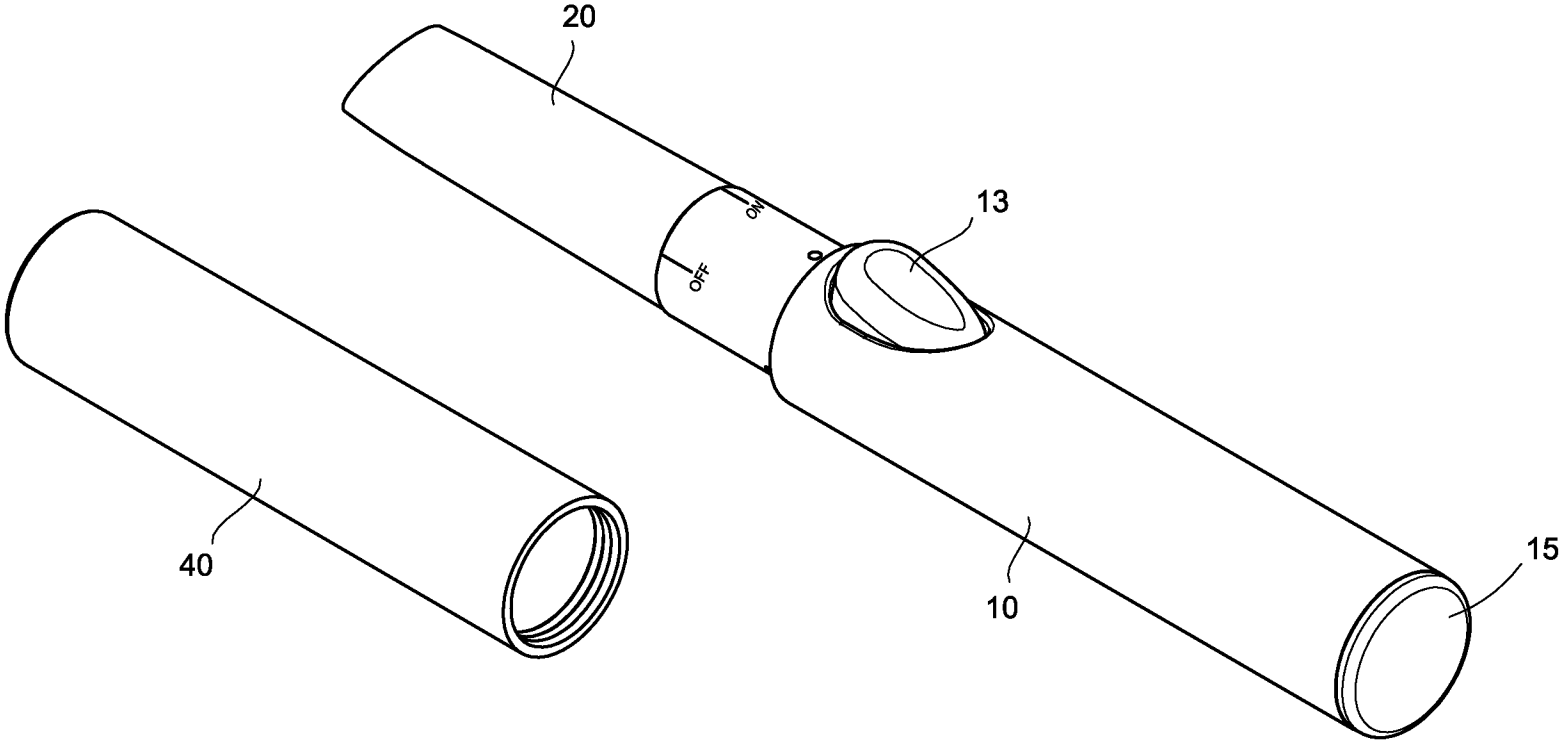
FIG. 2 is a perspective view of the cosmetic applicator of the present invention, a cover taken off from a cosmetic applicator body.
Figure 3:
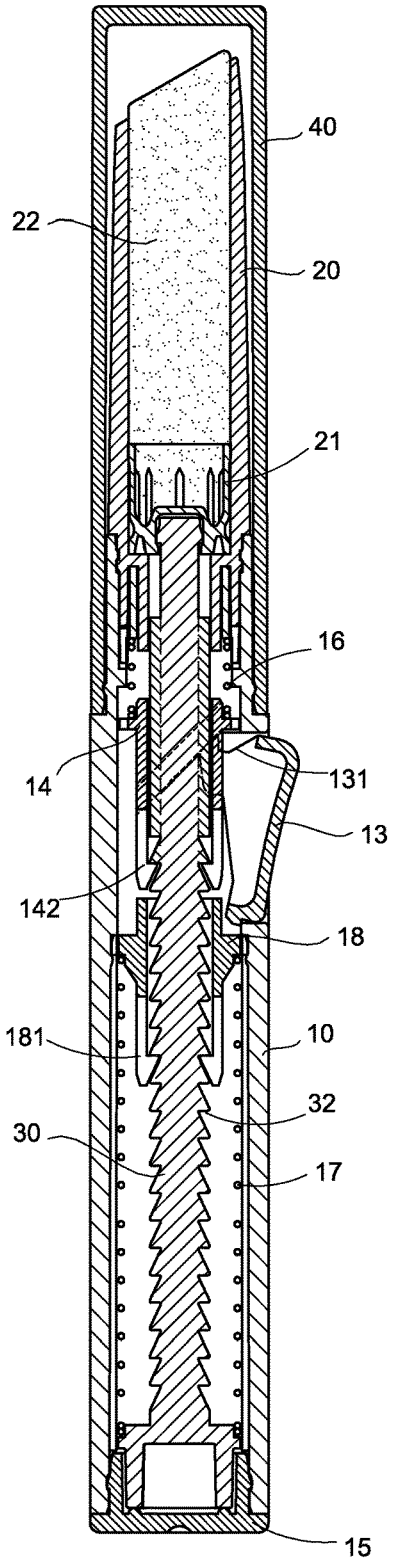
FIG. 3 is a cross-sectional view of the cosmetic applicator of the present invention.
Figure 4:
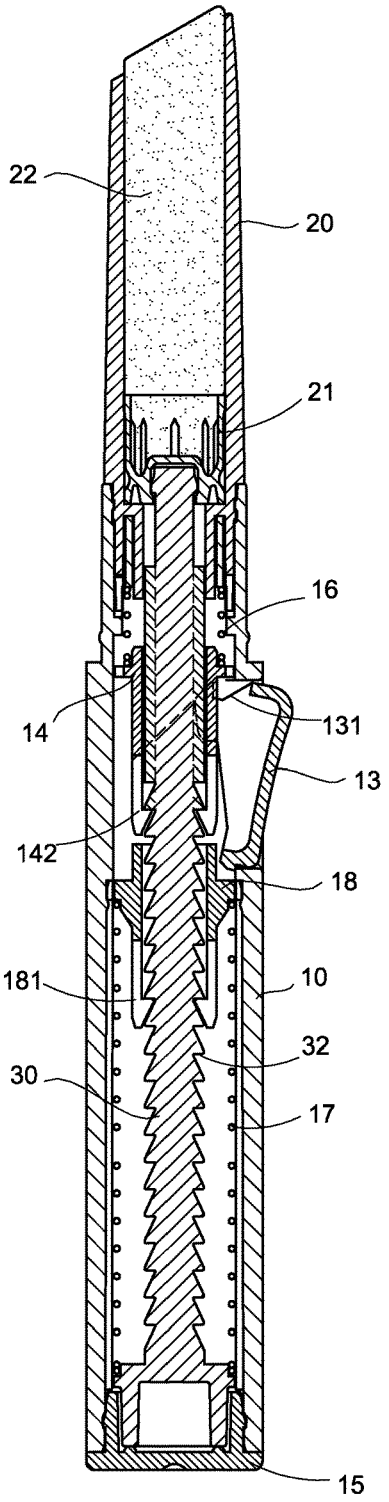
FIG. 4 is a cross-sectional view of the opened cosmetic applicator of the present invention in a use state.
Figure 5:
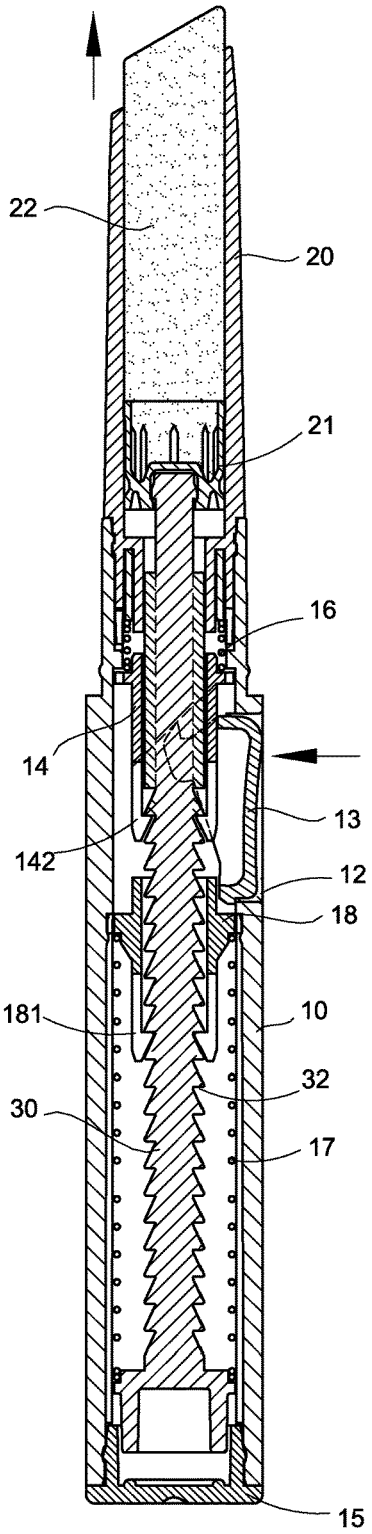
FIG. 5 is a cross-sectional view of the opened cosmetic applicator of the present invention, where a control button is pressed down for cosmetic material discharge.
Figure 6:
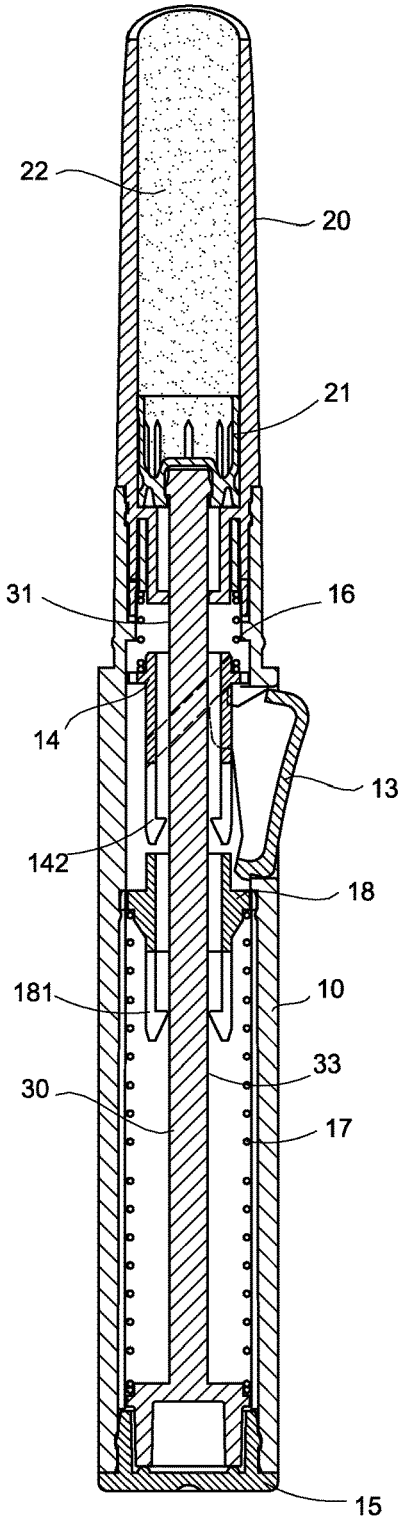
FIG. 6 is a cross-sectional view of the cosmetic applicator of the present invention, where the cosmetic material is retreated after makeup use.
Figure 7:
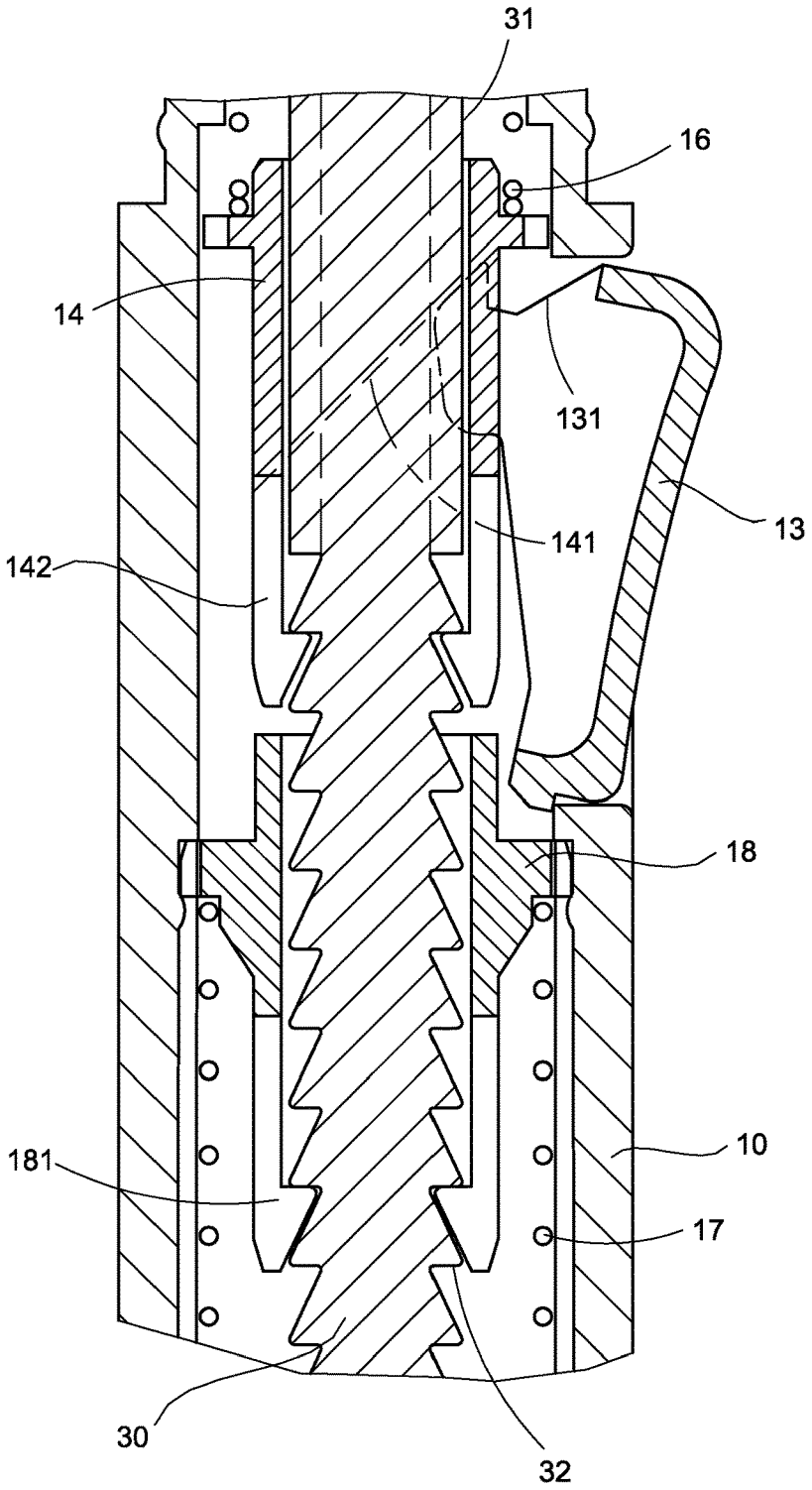
FIG. 7 is an enlarged cross-sectional view of the cosmetic applicator of the present invention, showing the clamp and drive assembly of a screw rod.
Figure 8:
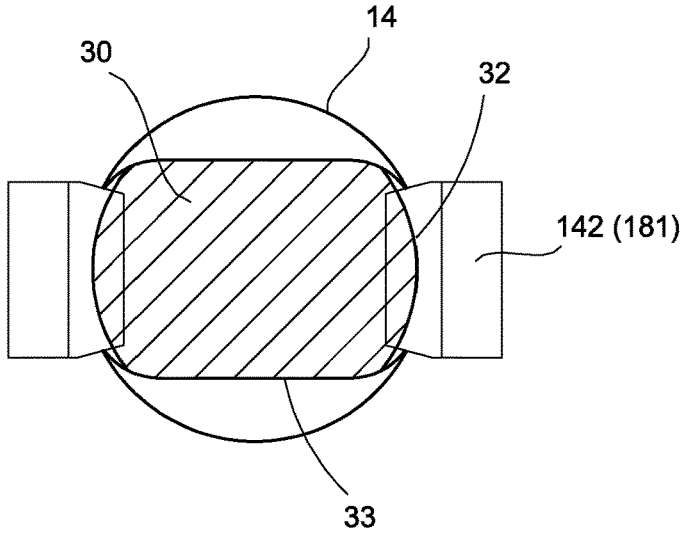
FIG. 8 shows the engagement of the screw rod with a driving element and thrust element.
Figure 9:
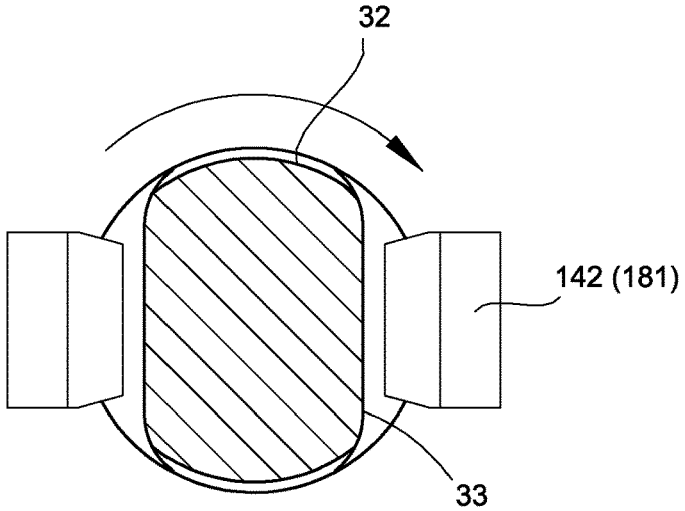
FIG. 9 shows the release of the screw rod from the driving element and thrust element.

Referring to FIGS. 1 to 9, a cosmetics applicator having a side control button of the present invention is applicable to cosmetic pencils or striped makeup materials. Here, taking the most common lipstick makeup utensil as an example to describe thereinafter, the cosmetic applicator of the present invention includes a pencil-like long tube body 10 having a stepped edge 11 on the top thereof for the insertion of a material holder 20 therein, thereby constituting a pencil-like toiletry structure, where one side of the long tube body 10 is configured with a side hole12 for the assembly with a control button 13 having a shape protruded out from bottom to top more and more gradually, the control button 13 capable of flush with the face of the tube body 10 when pressed down, and the inner side of the top end of the control button 13 is configured with a protruding push edge 131 forming an inclined guide adapted to move a driving element 14 by pushing vertically a corresponding taper arc edge 141configured on the side of the driving element 14. Furthermore, an engagement sheet 142 extended downward is respectively configured on the two sides of the driving element 14, a tail cover is adapted to seal the hollow bottom of the long tube body 10, and a spring 16 is installed between the driving element 14 inside the tube body 10 and the material holder 20, allowing the driving element 14 to be recovered when slid vertically. Furthermore, the bottom side of the control button 13 is fixed with a positioning thrust element 18 pushed against by an elastic element 17 from inside, and the two opposite sides of the thrust element 18 are respectively configured with an engagement sheet 181 having a barb extended downward and then inward. Furthermore, the material holder 20 has a hollow inside for the accommodation of cosmetic material therein, which allows the safe placement of a slotted seat 21 for the filling of cosmetic material, a lipstick strip in the embodiment, therein. In addition, the center of the bottom of the material holder 20 is configured with a guide insertion hole 23, which is usually formed into a parallel quadrilateral through hole having guide parallel sides, allowing a screw rod 30 having a guide section 31 with a cross-sectional shape similar to the one of the insertion hole 23 of the material holder 20 to be passed upward through the thrust element 18 and driving element 14 from the bottom of the long tube body 10, and then passed directly through the inner bottom of the material holder 20 and engaged with the slotted seat 21 for the insertion of the lipstick strip 22 therein; the screw rod 30 can be turned with the material holder 20 when the material holder 20 is turned. Furthermore, the lower half section of the screw rod 30 is formed into a ratchet surface 32 capable of respectively in engagement with the engagements 142, 181 of the driving element 14 and thrust element 18, which can have the stable discharge of the material (lipstick stripe) when the control button 13 actuates the driving element 14 to slide vertically. Furthermore, the two sides of the ratchet surface 32 of the screw rod 30 are respectively configured with a flat surface 33, the two flat surfaces 33 symmetry to each other; the material holder 29 can be rotated to separate the flat surfaces 33 from the thrust element 18 and driving element 14 and not retained thereby after the application of the material is done, preventing the material from being discharged when the control button 13 is touched carelessly; the rotation control positions may be simply represented by lines 19 engraved on the side of the top edge of the long tube body 10 or engagement position indications such as "ON" and "OFF", thereby convenient for the cosmetic use. Furthermore, an outer cover 40 is used to cover the top edge of the long tube body 10 from outside the material holder 20, ensuring the safe and complete storage of the cosmetic material.

When using the cosmetics applicator having a side control button of the present invention to put on makeup, a user only needs to remove the outer cover 40, turns the material holder 20 to the mark "ON" of the material discharge indicated on the top edge of the long tube body 10, and may then use one hand to hold the long tube body 10 to press the control button 13 down directly. The inclined guide push edge 131 protruded out from the top end of the control button 13, after the control button 13 is pressed down, will directly push the corresponding taper arc edge 141 configured on the side of the top of the driving element 14 to cause the driving element 14 to be slid upward. Meanwhile, the screw rod 30 is moved upward because the engagement sheets 142 hooked inward and extended from the two sides of the bottom of the driving element 14 hooks the ratchet surfaces 32 of the screw rod 30. As a result, the slotted seat 21 assembled on the top of the screw rod 30 is thus moved upward simultaneously, and the lipstick stripe 22 is further pushed to rise to the outside of the material holder 20; the lipstick stripe 22 can be extend out a required length depending on use requirements by press the control button 13 continuously, and may be extended out to the position where the slotted seat 21 is risen to the highest limit so that the cosmetic material can be used up, thereby providing a environmentally friendly and convenient makeup use. On the other hand, the material holder is turned back to the mark "OFF" indicated on the top edge of the long tube body 10 after the makeup, and the screw rod 20 is horizontally rotated 90 degrees simultaneously, allowing the ratchet surfaces 32 original engaged with the thrust element 18 to be separated therefrom. At this moment, the elastic recovery of the elastic element 17 inbuilt in the long tube body 10 causes the screw rod 30 to be naturally moved back to the bottom of the tube body 10, and the lipstick stripe 22 extended outside is retreated back to the cylindrical inside of the material holder 20, ensuring the safe storage of the lipstick stripe 22. In addition, the screw rod 30 after turned 90 degrees will not be in engagement with the driving element 14 or thrust element 18 used for transmission because the two sides thereof are flat, preventing the material to be discharged even if the control button 13 is pressed by mistake, thereby ensuring the safe storage of the lipstick stripe 22.

The cosmetics applicator of the present invention is mainly characterized in that one-handed operation can carry out the material discharge simply, and the button pressing operated in coordination with the engagement of ratchet surfaces allows the material to be accurately discharged bit by bit, not only being stable and accurate in the operation, but preventing the button pressing by mistake only by means of the simple turning of the material holder 20 after each makeup use. As to the storage of the lipstick strip 22, the turning of the material holder 20 allows the engagement of the driving element 14 and thrust element 18 with the ratchet surfaces to be released, and the elastic recovery of the elastic element 17 inbuilt in the long tube body 10 allows the screw rod 30 to be simply moved back to the original assembly position, ensuring the safe storage of the lipstick stripe 22 of cosmetic material inside the material holder 20. With the outer cover 40, the long tube body 10 can be covered and sealed accurately.

I claim:

1. A cosmetics applicator having a side control button, comprising a long tube body for hand griping, a slotted seat adapted to accommodate a lipstick stripe of cosmetic material, a material holder for the insertion of said slotted seat therein, and an outer cover outside said material holder adapted to cover a top end of said long tube body, wherein a top edge of said long tube body is formed into a stepped edge, allowing the engagement of said material holder therewith, thereby constituting a pencil-like cosmetic tool structure, wherein one side of said long tube body is configured with a side hole for the assembly of a control button therewith, an inner edge of one end thereof is configured with a protruding push edge adapted to push a driving element assembled on a top end of an inside of said long tube body, an outside of said driving element inside said long tube body is configured with an elastic element adapted for the reset assistance of said driving element after sliding vertically, an inner bottom of said long tube body assembled with said control button is fixed with a thrust element pressed and positioned by said elastic element, and a barb-like engagement sheets extended downward is respectively configured on two sides of said thrust element; said slotted seat inside said material holder is used for the accommodation of a cosmetic material, a guide insertion hole is configured on a bottom center of said material holder, a screw rod is passed upward through said bottom of said long tube body to be in engagement with said thrust element and driving element, a guide section configured on a face of said screw rod is passed through an corresponding insertion hole of said material holder up to an inner bottom of said material holder to be in combination with said slotted seat, allowing said screw rod to be turned with said material holder, a lower half of said screw rod is set to be a ratchet surface, two sides thereof are respectively formed into a symmetrical flat surface, allowing ratchets to be engaged with said engagement sheets of said driving element and thrust element; said driving element is slid upward when said control button is pressed down, achieving a stable bit-by-bit material discharge when said control button is pressed down continuously; said screw rod, after makeup is done, is driven by said material holder to turn to a state of said flat surfaces facing said engagement sheets, allowing said ratchet surfaces to be separated from and not engaged with said engagement sheets, and the elastic recovery of said elastic element outside said screw will then cause said lipstick strip to be automatically retreated inside said material holder and stored therein safely.

2. The applicator according to claim 1, wherein said control button has a shape protruded out from bottom to top more and more gradually, allowing said control button to be flush with a face of said long tube body when pressed down.

3. The applicator according to claim 1, a side of said driving element is formed into a taper arc edge, allowing said inclined guide push edge protruded out from said top end of said control button to directly push said taper arc edge to cause said driving element to be slid upward after said control button is pressed down.

4. The applicator according to claim 1, wherein a bottom center of said material holder is configured with a guide insertion hole formed into a through hole having guide side faces; said through hole is rectangular.

5. The applicator according to claim 1, wherein a side of a top edge of said long tube body is configured with engraved lines or engagement position marks indicated "ON" and "OFF" for viewing.

* * * * *